United States Patent [19]

Odenthal

[11] 3,983,444

[45] Sept. 28, 1976

[54] DUAL BEAM CRT WITH INNER GUN AND OUTER GUN SHIELD MEANS FOR CORRECTING KEYSTONE DISTORTION

[75] Inventor: Conrad John Odenthal, Portland, Oreg.

[73] Assignee: Tektronix, Inc., Beaverton, Oreg.

[22] Filed: Oct. 24, 1975

[21] Appl. No.: 625,612

Related U.S. Application Data

[62] Division of Ser. No. 486,022, July 5, 1974, Pat. No. 3,921,025.

[52] U.S. Cl. ..... 313/413; 313/437

[51] Int. Cl.[2] ..... H01J 29/51; H01J 29/82

[58] Field of Search ..... 313/413, 435, 438, 409, 313/412, 415, 425, 432, 434, 437, 417, 411

[56] References Cited

UNITED STATES PATENTS

| | | | |
|---|---|---|---|
| 3,358,172 | 12/1967 | Lewis | 313/411 |
| 3,670,199 | 6/1972 | Hawes | 313/413 X |
| 3,819,984 | 6/1974 | Hawken | 313/413 X |

*Primary Examiner*—Robert Segal
*Attorney, Agent, or Firm*—George T. Noe

[57] ABSTRACT

A dual-beam cathode-ray tube having a pair of electron guns and associated deflection means disposed side-by-side on each side of a central axis is described in which the electron guns are parallel and the deflection means includes beam centering plates and angled horizontal deflection plates to direct the electron beams toward the central axis, precluding the need for a large-diameter tube neck in which the entire gun structures are angled. Bowing control plates are disposed adjacent the beam centering plates to minimize trace bowing, and an intergun shield is disposed between the horizontal deflection plates to control and correct display pattern geometry distortion.

3 Claims, 8 Drawing Figures

DUAL BEAM CRT WITH INNER GUN AND OUTER GUN SHIELD MEANS FOR CORRECTING KEYSTONE DISTORTION

This is a division of application Ser. No. 486,022, filed 7/5/74, now U.S. Pat. No. 3,921,025.

BACKGROUND OF THE INVENTION

The present invention relates generally to electron beam tubes having dual beams and associated deflection means, and more particularly to single scan expansion mesh cathode ray tubes having dual electron beam guns that provide asymmetrical horizontal scanning.

In cathode-ray tubes having dual electron beams for independent, multitrace operation, it has been a common practice to provide a pair of electron guns mounted in a stacked configuration such that one gun is disposed above the central axis of the tube, and the other gun disposed below the central axis, both guns being mounted in the same vertical plane so that the horizontal angles of the two electron beams swept horizontally across the tube screen are equal. Since the screen is transverse to the central axis of the tube and the guns are mounted off-axis, the guns are angled toward the central axis so that each gun can scan the entire screen. However, this angling distorts the scanned display pattern from a rectangle to a trapezoid, which can easily be corrected by adjusting the horizontal deflection plates to be nonparallel from side to side thereby affecting the horizontal sensitivity as the tube is scanned vertically. If a divergent post deflection acceleration (PDA) field is used and full overlap of scan is desired, the guns have to be angled quite steeply, resulting in a large diameter cathode-ray tube which takes up useful space.

U.S. Pat. No. 3,819,984, assigned to assignee of the present application, teaches the concept of mounting a pair of electron guns parallel to each other in a horizontal plane in order to reduce the tube neck diameter. However, the use of a single scan expansion mesh in a cathode-ray tube having parallel electron guns and associated deflection structures produces the undesirable effect of causing the two electrical centers of the guns to be widely separated, for example, as much as eight centimeters, and introduces a vertical trace bowing problem at the center of the display screen.

SUMMARY OF THE INVENTION

The present invention overcomes the disadvantages of widely separated electrical centers mentioned hereinabove by angling the horizontal deflection plates to direct the electron beams toward the central axis of the tube, and by disposing a set of beam-centering plates through which the electron beam passes between each set of vertical deflection plates and angled horizontal deflection plates to cause the beams to converge before entering the space between the horizontal deflection plates. In addition, the beam centering plates have radiussed edges to correct for vertical trace bowing introduced by the mesh. Correction control to compensate for part variations introduced by mass production is provided by a bowing control plate adjacent each set of beam centering plates to which a variable voltage may be applied to change the apparent radius of the beam-centering plates as seen by the electron beam.

An intergun shield is disposed between the closely mounted horizontal deflection plates to minimize the electrical capacitance therebetween, preventing high-frequency cross talk between the two guns. This shield is wider than the horizontal deflection plates and has scalloped edges to accomodate the deflection-plate support legs while providing shielding therefor. Separate inner-gun and outer-gun shield are additionally provided to control horizontal keystone geometry and edge pattern distortion.

It is therefore one object of the present invention to provide a dual-beam cathode-ray tube having parallel electron guns disposed side by side in which the electrical centers for the guns are coincident.

It is another object of the present invention to provide a novel means for directing the electron beam of an off-center electron gun in a cathode-ray tube toward the central axis of such tube to preclude the need for a large diameter tube neck.

It is a further object of the present invention to provide a bowing control means to correct vertical trace bowing caused by a scan expansion mesh in a dual beam cathode-ray tube.

It is still another object of the present invention to provide an intergun shield for use in a dual beam cathode-ray tube in which the horizontal deflection plates are mounted close together.

It is still a further object of the present invention to provide an intergun shield assembly which includes inner-gun and outer-gun shield means for eliminating horizontal keystone and edge pattern distortion in a dual beam cathode-ray tube.

It is yet another object of the present invention to provide an improved dual-beam cathode-ray tube having a single scan expansion mesh in in which side-by-side electron guns are controlled to provide overlapping rectangular display patterns.

BRIEF DESCRIPTION OF THE DRAWINGS

The foregoing and other objects, features, and advantages of this invention will become apparent from the following detailed description of an illustrative embodiment which is to be read in conjunction with the accompanying drawings in which.

DETAILED DESCRIPTION

Figure 1:
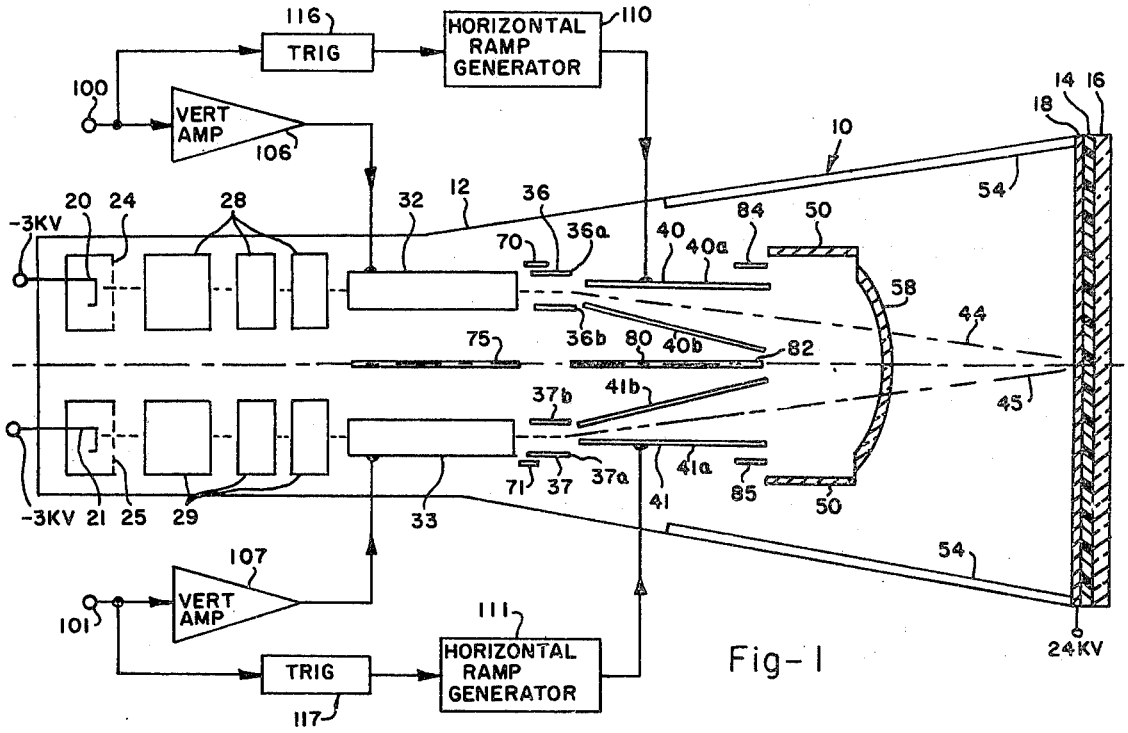
FIGS. 1 and 2 are schematicized top and side views respectively of a dual-beam cathode-ray tube according to the present invention.

As shown in FIG. 1, an electron discharge which may be a cathode-ray tube 10 or other electron beam deflection device has an evacuated envelope 12 of glass, ceramic, or other suitable insulating material in which a fluorescent screen 14 of phosphor material coated on the inner surface of a light transparent faceplate 16 which is secured onto the front end of such envelope. A thin metallic coating 18 preferably of aluminum is disposed on the gun side of screen 14.

Two separate electron guns of conventional design are disposed in envelope 12 which include cathodes 20 and 21, control grids 24 and 25, and focusing anodes 28 and 29. In addition, two separate electron beam deflection systems are provided in envelope 12 including a first pair of vertical deflection plates 32 and a second pair of vertical deflection plates 33, a first pair of beam centering plates 36 and a second pair of beam centering plates 37, and a first pair of horizontal deflection plates 40 and a second pair of horizontal deflection plates 41.

Figure 2:
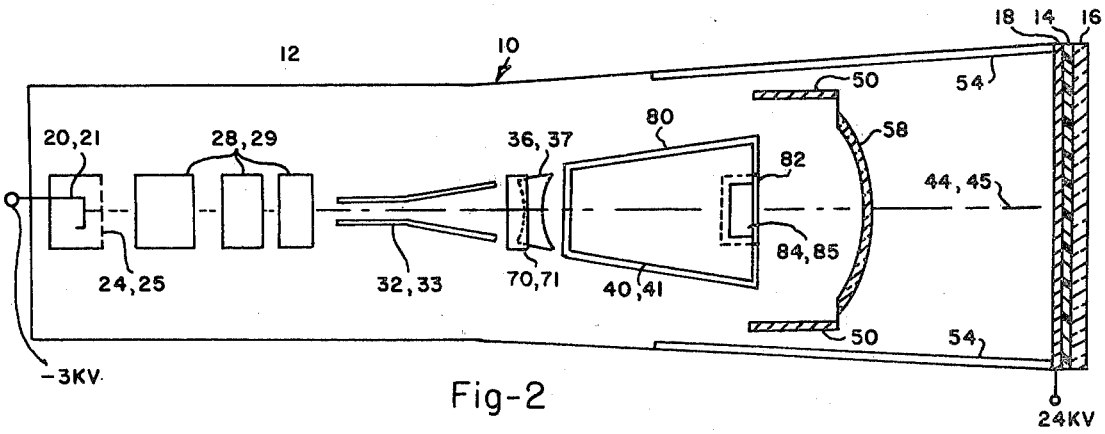

As can be discerned from FIG. 1 and FIG. 2, where like elements have like reference numerals, cathode 20 has associated therewith control grid 24, focusing anodes 28, vertical deflection plates 32, beam centering plates 36, and horizontal deflection plates 40 for controlling an electron beam 44 produced by cathode 20, to which −3 kilovolts may be applied. Similarly, cathode 21 may have −3 kilovolts applied thereto, and has associated therewith control grid 25, focusing anodes 29, vertical deflection plates 33, beam centering plates 37, and horizontal deflection plates 41 for controlling the electron beam 45 produced by cathode 21.

An annular mounting and shielding member 50 is disposed in the envelope 12 so that the output ends of horizontal deflection means 40 and 41 are positioned therein, and it is operated at near ground potential. Member 50 serves to shield the horizontal deflection means from the high voltage of post deflection acceleration anode 54 which may consist of a conductive coating on the interior surface of envelope 12 in electrical contact with metallic coating 18 and has an operating potential of 20 to 24 kilovolts thereon. A scan expansion mesh 58 is secured on the member 50 which has an outwardly-directed hemispherical configuration to provide diverging lens for scan expansion in the manner taught in a book entitled "Cathode-Ray-Tubes," pp. 51–54, published by Tektronix, Inc., in 1970. This mesh 58 causes the electron beams to be effectively scanned over the screen in full overlap operation, since both beams must be capable of covering the same screen area.

After leaving the electron guns, the electron beams 44 and 45 first pass through the vertical deflection plates 32 and 33 respectively. Conventional vertical defletion plates as shown in FIGS. 1 and 2 will provide satisfactory operation up to about 150 megahertz; however, for cathode-ray tube operation above this frequency, a vertical deflection means of the type disclosed in U.S. Pat. No. 3,694,689 will provide best operation.

Beam centering plates 36 and 37 are identical in configuration and each pair comprises an outer planar plate 36*a*, 37*a* and an inner planar plate 36b, 37b, which are spaced equidistant from each other and disposed parallel to the central axis of the tube to receive the electron beams 44 and 45 passing from the vertical deflection plates 32 and 33 respectively. The inner beam centering plates 36*b* and 37*b*, which are closest to the central axis of the tube, are biased with an electrical potential which is positive to the outer plates 36*a* and 37*a* respectively to cause the electron beams 44 and 45 to be directed toward the central axis of the tube along the center lines of the horizontal deflection plates 40 and 41 as shown in FIG. 1. The beam entrance and exit portions of the beam centering plates may be of an arcuate configuration as shown in FIG. 2 to correct for vertical trace bowing introduced by the mesh. As can be discerned, a beam 44, 45 which is deflected upward or downward by the vertical deflection plates 32,33 must travel through a longer path as it passes through the beam centering plates 36,37 and will be horizontally deflected more by the beam centering plates than would a beam passing through the center thereof. Hence, a bow is deliberately introduced into the vertical trace which is opposite to that introduced by the mesh 58, resulting in a straight vertical center trace viewed on the screen 14.

Compensator plates 70 and 71, which are planar plates with straight edges, are mounted adjacent the beam entrance edge of the outer beam centering plates 36a and 37a to provide a control of the amount of vertical tracing bowing discussed in the preceding paragraph to compensate for part tolerances and slight misalignment of parts in the manufacture of the cathode-ray tubes. A A variable electrical potential is applied to each compensator plate 70 and 71 to produce an electrostatic field whose equipotential lines interfere with the equipotential lines at the extreme edge of each set of beam centering plates 36 and 37 respectively, thereby changing the apparent curvature of the entrance edge of the outer beam centering plates 36*a* and 37*a* to establish the required straight vertical trace.

Horizontal deflection plates 40 and 41 are identical in configuration and each pair comprises an outer plate 40*a*, 41*a*, and an inner plate 40*b*, 41*b*, which are typically about 0.05 inches apart at the entrance and about 0.35 inches apart at the exit to form a wedge-shaped spacing therebetween. Each set of horizontal deflection plates is disposed at an angle within the envelope 12 so that the electron beams 44 and 45 directed toward the central axis of the tube by the aforementioned beam centering plates may enter and pass through without obstruction along a line corresponding to the electrical center of the viewing screen 14. The electrical center of the screen is defined as that point at which the beams 44 and 45 strike when the vertical deflection plates 32, 33 and the horizontal deflection plates 40 and 41 are all grounded together, establishing zero volts difference between the pairs of plates. The effect of the beam centering plates 36 and 37, the horizontal deflection plates 40 and 41, and the scan expansion mesh 58 is to establish the electrical center of the screen at the physical center of the screen, even though the side-by-side electron guns are physically several millimeters apart.

Plates 75 are mounted between the pairs of vertical deflection plates to prevent the electrostatic fields of these vertical deflection means from interfering with each other as well as providing compensation so that the characteristic impedance is constant therealong. Plates 75 are operated at near the average potential of the vertical deflection means.

Intergun isolation shield 80 is disposed between the pairs of horizontal deflection plates 40 and 41 to prevent the electrostatic fields generated by the respective pairs of horizontal deflection plates from affecting each other. Shield 80 is operated at or near the average potential of the horizontal deflection means. This shield also serves to minimize the capacitance between the sets of deflection plates, thus minimizing high-frequency crosstalk between the two gun systems.

Inner gun shield 82, and out gun shields 84 and 85 are disposed adjacent the exit of horizontal deflection plates 40 and 41, and are operated at potentials sufficient to correct overall display pattern distortion, particularly horizontal keystone distortion, which will be further discussed later.

Further geometry correction can be effected by providing the horizontal deflection plates 40 and 41 with arcuate, or radiussed exit edges rather than the straight exit edge shown in the drawings.

Input signals are applied at input terminals 100 and 101, which are connected respectively to vertical amplifiers 106 and 107. Vertical amplifiers 106 and 107 develop push-pull output signals which are connected respectively to vertical deflection means 32 and 33. Horizontal ramp generators 110 and 111 are triggered in response to the receipt of input signals at input terminals 100 and 101 by providing trigger circuits 116 and 117 having their inputs connected respectively to input terminals 100 and 101 and having their outputs connected respectively to the inputs of horizontal ramp generators 110 and 111. Horizontal ramp generators develop push-pull sawtooth signals suitable for driving deflection plates, and these signals are applied respectively to horizontal deflection means 40 and 41.

Thus, electron beams 44 and 45 emitted respectively from cathodes 20 and 21 are properly focused by focusing anodes 28 and 29, thereafter vertical deflection means 32 and 33 and horizontal deflection means 40 and 41 operate on the focused electron beams to deflect the beams in accordance with the signals at input terminals 100 and 101 whereafter the beams are passed through scan expansion mesh 58 whereby they are accelerated about 24 kilovolts before they strike the target comprising phosphor layer 14 and metallic coating 17 which produces light images of these electron beams, which under most circumstances will be the signal waveform traces of the vertical deflection signals. The thin film of aluminum, which is several angstroms thick, is electron transparent and reflects the light emitted by the phosphor layer 14 to increase the brightness of the displays in a conventional manner.

Figure 3:
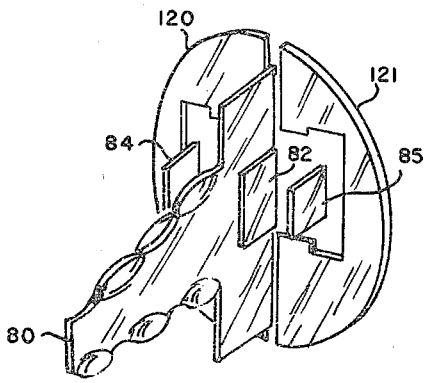
FIG. 3 shows a perspective view of an intergun shield assembly for use in a dual-beam cathode-ray tube.
Figure 4:
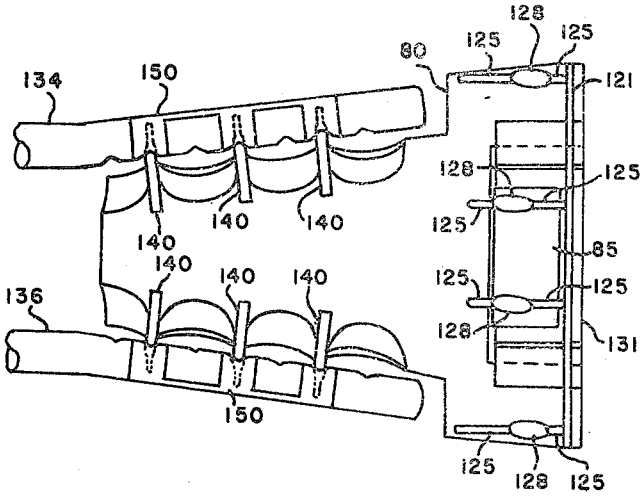
FIGS. 4 and 5 show side and top views respectively of an intergun shield assembly for use in a dual-beam cathode-ray tube.
Figure 5:
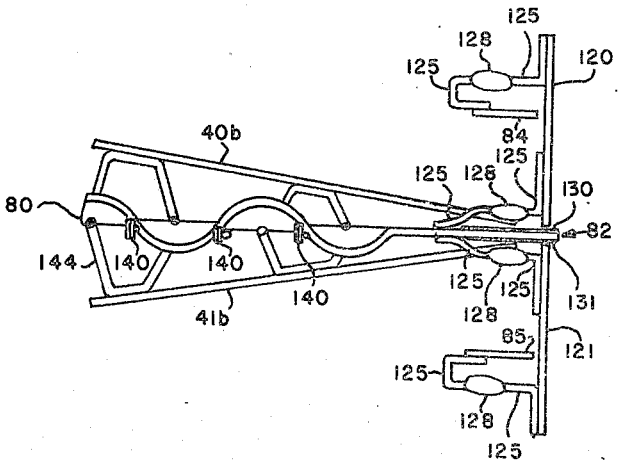

FIG. 3 shows a perspective view of an intergun and crosstalk shield assembly in accordance with the preferred embodiment of the present invention, while FIGS. 4 and 5 show respectively side and top views of this preferred embodiment. Again, like elements have like reference numerals to facilitate reference to the drawings. An isolation shield comprising slotted half-discs 120 and 121 is insulatively attached to the intergun isolation shield 80 on a plane transverse to the shield 80 to provide isolation of the horizontal deflection means from the high-voltage field established by the post deflection anode 54 described earlier. The outer gun shields 84 and 85 are insulatively attached to the shield 120 and 121 respectively. The intergun shield 80, isolation shields 120 and 121, and outergun shields 84 and 85 are assembled by means of support legs 125, which may be wires spot-welded to the various members and insulated from each other by glass beads 128.

Inner gun shield 82 comprises two separate shield members 130 and 131 which are insulated from each other and insulatively mounted in the space provided in intergun shield 80.

The completed intergun shield assembly hereinabove described is mounted in the tube between the two pairs of horizontal deflection plates 40 and 41, attached to the inner horizontal deflection plate support rods 134 and 136, which may suitably be fabricated of glass or other insulating material, by means of support legs 140 which are spot welded to isolation shield 80 and embedded in the support rods 134 and 136 as shown in FIG. 4.

The edges of shield 80 are scalloped to permit the inner horizontal deflection plate support legs 144 which are spot welded to the inner horizontal deflection plates **40*b* and 41*b* to be embedded in the support rods 134 and 136 without touching the shield 80. This arrangement allows the two sets of horizontal deflection plates 40 and 41** to be mounted as close together as possible to achieve full scan overlap while minimizing display distortion, and simultaneously reducing the capacitance due to the dielectric mediums, i.e. the air and the support rods, between the two sets of horizontal deflection plates.

As can be discerned, the deflection plate support legs 144 are at the same electrical potential as their associated deflection plates **40*b* and 41*b*, and to complete the shielding and further minimize capacitance in the support rods 134 and 136, the outside of the rods 134 and 136 are coated with an electrically conductive paint 150 in bands connecting the shield 80 support legs 140**.

Figure 6A:
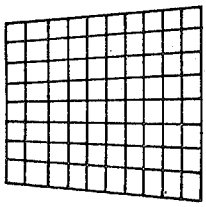
FIGS. 6A, 6B, and 6C illustrate rectangular display patterns formed by an electron beam on the fluorescent screen of a cathode-ray tube.
Figure 6B:
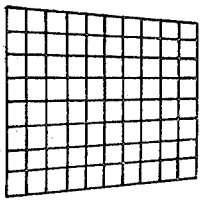
Figure 6C:
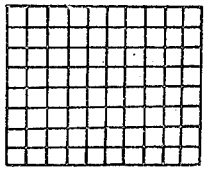

In the absence of the inner gun shields 82 and outer gun shields 84 and 85, the display generated by the left electron gun means would provide a keystone-shaped display as shown in FIG. 6A whereby the horizontal lines above and below the center horizontal line will deviate away therefrom in a direction from left to right, whereas the display generated by the right electron gun means would provide a keystone-shaped display as shown in FIG. 6B whereby the horizontal lines above and below the center horizontal line will deviate away therefrom in a direction opposite to that of the display of the left gun means as shown by FIG. 6A. Thus, the interaction of the electrostatic fields of the vertical and horizontal deflection means without the innergun shields 82 and outer gun shield 84 and 85 will provide displays having keystone distortion as shown by FIGS. 6A and 6B in a dual-beam cathode-ray tube wherein the electron guns are disposed parallel to each other in side-by-side relationship. When the innergun shields 82 and outergun shields 84 and 85 are provided for the horizontal deflection means in accordance with the present invention, a true rectangular display as shown in FIG. 6C is provided thereby correcting for keystone distortion.

It will be obvious to those having ordinary skill in the art that many changes may be made in the details of the above-described preferred embodiment without departing from the spirit of the invention. While a conventional cathode-ray tube has been described, it is possible to employ the present invention in a bistable charge image storage tube including the type in which the phosphor layer also functions as the storage dielectric. Therefore, the scope of the present invention is to be determined by the following claims.

I claim:

1. A horizontal deflection system for a dual electron beam apparatus comprising;

a first and a second pair of horizontal deflection plates disposed side-by-side, each of said pairs of plates including an inner plate and an outer plate spaced from each other;

support means for supporting said deflection plates;

isolation shield means disposed between said first and second pair of deflection plates and being supported by said support means; and innergun and outergun shield means carried by said isolation shield means and disposed adjacent the exit of said deflection plates for correcting keystone pattern distortion.

2. The horizontal deflection system according to claim 1 wherein said support means comprises support legs carried by insulative support rods, and wherein said isolation shield means includes a shield plate attached to said insulative support rods and insulated from said deflection plates, said shield plate having scalloped edges to provide insulative mounting clearance for said support legs.

3. The horizontal deflection system according to claim 1 wherein said innergun and outergun shield means are insulated from said isolation shield means and said deflection plates.

* * * * *